US009436150B2

(12) United States Patent
Uezono

(10) Patent No.: US 9,436,150 B2
(45) Date of Patent: Sep. 6, 2016

(54) INTERLOCK MECHANISM IN IMAGE FORMING APPARATUS AND ELECTRICAL DEVICE

(71) Applicant: CANON KABUSHIKI KAISHA, Tokyo (JP)

(72) Inventor: Takaomi Uezono, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/809,148

(22) Filed: Jul. 24, 2015

(65) Prior Publication Data

US 2016/0054699 A1 Feb. 25, 2016

(30) Foreign Application Priority Data

Aug. 20, 2014 (JP) ..... 2014-167954

(51) Int. Cl.
*G03G 15/00* (2006.01)
*G03G 21/16* (2006.01)

(52) U.S. Cl.
CPC ..... *G03G 15/80* (2013.01); *G03G 21/1633* (2013.01)

(58) Field of Classification Search
None
See application file for complete search history.

(56) References Cited

U.S. PATENT DOCUMENTS 6,356,424 B1 * 3/2002 Myong ..... H02H 3/085 361/106

FOREIGN PATENT DOCUMENTS

| | | | |
|---|---|---|---|
| JP | 06004158 A | * | 1/1994 |
| JP | 2002-247752 A | | 8/2002 |
| JP | 2007-152646 A | | 6/2007 |
| JP | 2009-300944 A | | 12/2009 |

OTHER PUBLICATIONS

Machine translation of Uno JP H06-4158 (1994).*

* cited by examiner

*Primary Examiner* — David Gray
*Assistant Examiner* — Sevan A Aydin
(74) *Attorney, Agent, or Firm* — Fitzpatrick, Cella, Harper & Scinto

(57) ABSTRACT

An opening and closing portion is opened and closed. A switch is turned off when a voltage applied to a drive terminal is smaller than a first voltage and to be turned on when the voltage is greater than or equal to a second voltage. A drive unit generates a drive voltage. A first line applies the drive voltage to the switch. A second line is arranged such that at least a part thereof is near the first line. A voltage drop element provided on the first line drops a voltage applied from the second line through the first line to the drive terminal when the first line and the second line short-circuit in a state where the portion is open, to lower the voltage applied to the drive terminal to be smaller than the first voltage.

19 Claims, 11 Drawing Sheets

| | PERCENTAGE OF APPLIED VOLTAGE WITH RESPECT TO RATED VOLTAGE |
|---|---|
| RELAY ON VOLTAGE | 70% OR MORE |
| RELAY OFF VOLTAGE | LESS THAN 10% |

| | |
|---|---|
| TYPICAL INTER-PATTERN DISTANCE | 0.15mm |
| ENLARGED INTER-PATTERN DISTANCE | 1.0mm |

+24V
120
130
d1
126
125
481
482
127
128
435
431
433
432
428
429
RLD
SAFE
a
b
c
d

+24V
120
483
441
442
443
434
472
471
+24U
444

+24V
120
483
441
442
443
485
472
471
+24U
444

INTERLOCK MECHANISM IN IMAGE FORMING APPARATUS AND ELECTRICAL DEVICE

BACKGROUND OF THE INVENTION

1. Field of the Invention

The present invention relates to an electrical device such as an image forming apparatus (for example, a copier, a printer, or a facsimile (FAX)).

2. Description of the Related Art

Inside an electrophotographic image forming apparatus, a voltage higher than an alternating-current voltage of a commercial power supply has been used. Meanwhile, there have been cases where an operator opens a door provided on an image forming apparatus in order to replace cartridges or remove jammed sheets. Moreover, there are gears or the like that are rotated by a motor inside an image forming apparatus. Accordingly, an interlock mechanism for shutting off a current supplied from a power supply circuit when a door is opened has been adopted. The current supplied from the power supply circuit is thus shut off when the door is opened. Sometimes a relay and an interlock switch are provided as an interlock mechanism. The interlock switch is turned off when the door is opened, and the contact of the relay is opened in conjunction with the turning off of the switch, thereby stopping the supply of the current.

Incidentally, there are cases where a power supply line or a signal line such as that of a CPU are arranged near a line to a drive terminal of an interlock switch or a relay. When these lines short-circuit, the contact of the relay sometimes remains closed despite the door being open. In Japanese Patent Laid-Open No. 2007-152646, a distance between these lines is longer than a common insulation distance so that short-circuiting between lines are less likely to occur.

However, the longer the distance between the lines is, the larger the size of the circuit board becomes.

SUMMARY OF THE INVENTION

In view of this, the present invention provides an electrical device and an image forming apparatus that can shut off a current supplied from a power supply to a load even when short-circuiting occurs between lines and also are advantageous in terms of reducing the size of a circuit board.

The present invention provides an image forming apparatus comprising the following elements. An opening and closing portion is configured to be capable of opening and closing. A switch is configured to be turned off when a voltage applied to a drive terminal is smaller than a first voltage and to be turned on when the voltage applied to the drive terminal is greater than or equal to a second voltage that exceeds the first voltage. A drive unit is configured to generate a drive voltage. A first line is configured to be used to apply the drive voltage to the drive terminal of the switch. A second line is arranged such that at least a part thereof is near the first line. A voltage drop element is provided on the first line and is configured to drop the voltage applied to the drive terminal. The voltage drop element drops a voltage applied from the second line through the first line to the drive terminal by a predetermined voltage when the first line and the second line short-circuit in a state where the opening and closing portion is open, so as to lower the voltage applied to the drive terminal to be smaller than the first voltage, thereby turning off the switch.

Further features of the present invention will become apparent from the following description of exemplary embodiments (with reference to the attached drawings).

DESCRIPTION OF THE EMBODIMENTS

First Embodiment

Figure 1:
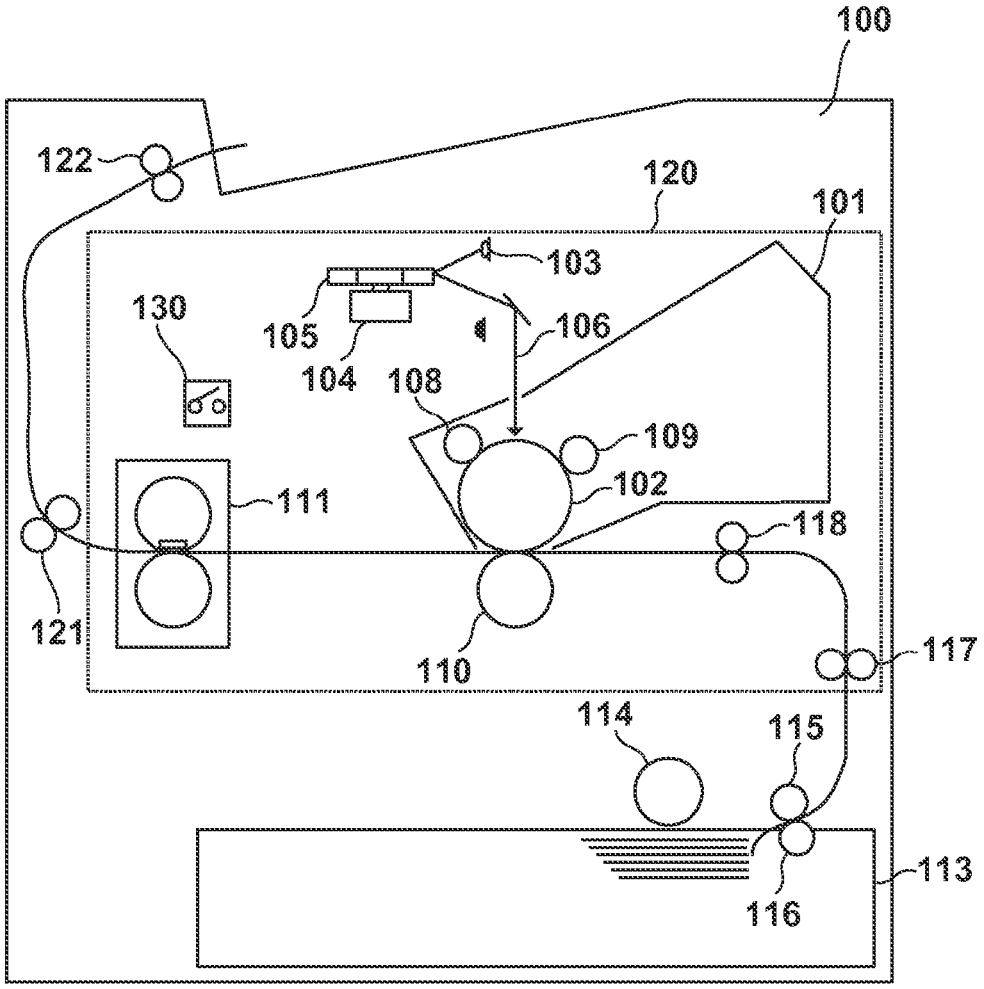
FIG. 1 is a diagram showing an overall configuration of an image forming apparatus.

FIG. 1 is a schematic cross-sectional view of an image forming apparatus. An image forming apparatus 100 is, for example, an electrical device such as an electrophotographic printer, a facsimile, a copier or a multifunctional printer. A toner cartridge 101 is a cartridge that is detachable from the image forming apparatus 100 and accommodates toner or the like. A photoreceptor 102 is an image carrier that carries electrostatic latent images and toner images. A semiconductor laser 103 is a light source that outputs light in accordance with input images. A rotating polygon mirror 105 is an exposing apparatus or an optical scanning apparatus that is rotated by a scanner motor 104 and deflects a laser light 106 to perform scanning on the photoreceptor 102. The laser light 106 is a ray of light emitted from the semiconductor laser 103, deflected by the rotating polygon mirror 105, and used to perform scanning on the photoreceptor 102. A charging roller 108 is a charging device for uniformly charging the photoreceptor 102. A developing roller 109 is a developing device that develops, using toner, electrostatic latent images formed on the photoreceptor 102 so as to form toner images. A transfer roller 110 is a transfer device for transferring a toner image developed by the developing roller 109 to a predetermined sheet. A fixing device 111 is a unit for fixing the toner transferred to the sheet by thermally fusing the toner. A sheet supplying cassette 113 is a container for accommodating sheets. Sheets are supplied from the sheet supplying cassette 113 to a conveyance path by a sheet supplying roller 114 rotating one time. A feed roller 115 and a retard roller 116 are a pair of rollers that separate multiple sheets picked up by the sheet supplying roller 114 into individual sheets. Conveyance path rollers 117, 118, 121, 122 are rollers for conveying sheets.

The image forming apparatus 100 has a door 120 that can be opened and closed by a user, and the fixing device 111 and the toner cartridge 101 can be attached to/detached from the apparatus by opening this door 120. An interlock circuit 130 is a circuit that shuts off a current supplied to each unit from a power supply when this door 120 is opened. Note that the interlock circuit 130 resumes the supply of current from the power supply to each unit when the door 120 is closed.

Figure 2:
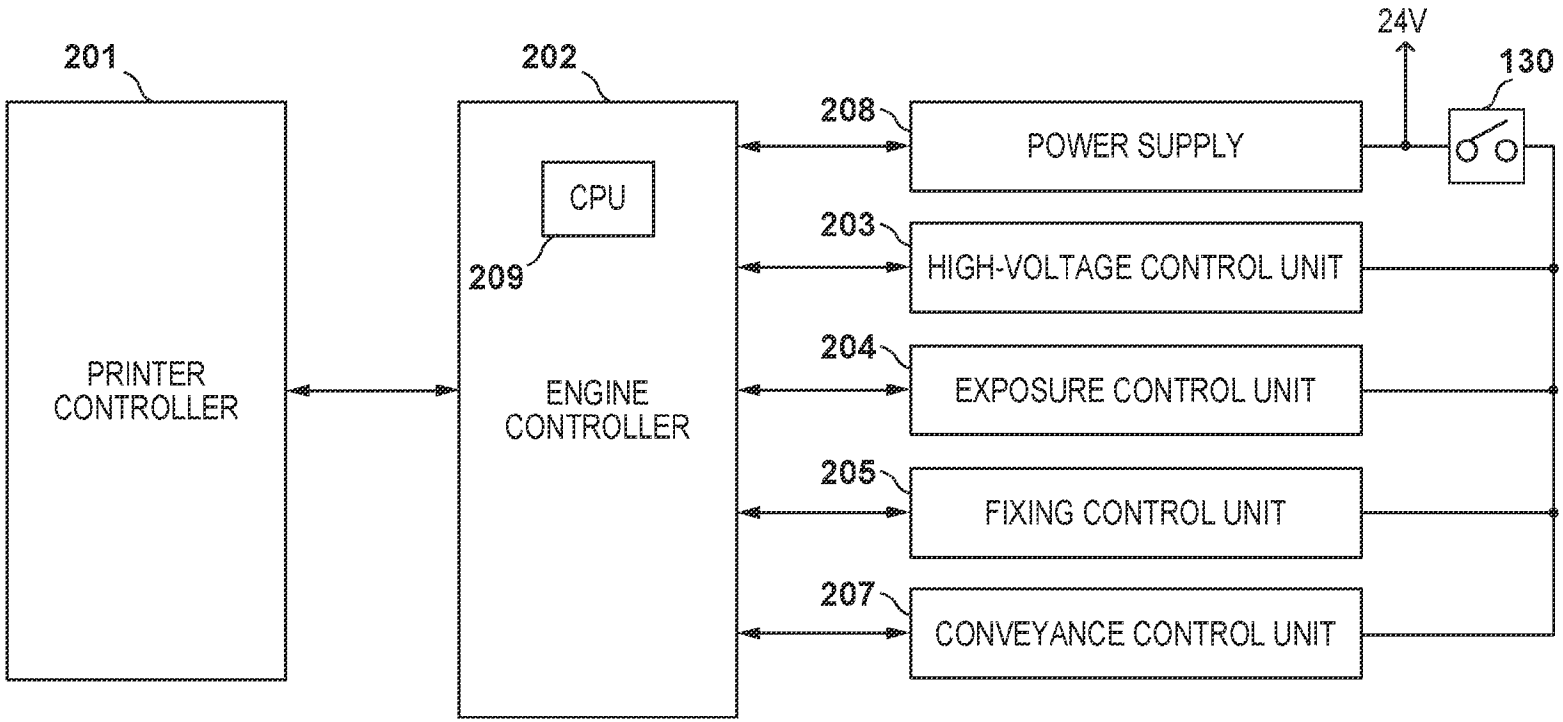
FIG. 2 is a block diagram showing a circuit configuration of an image forming apparatus.

FIG. 2 is a block diagram of a control system in the image forming apparatus 100. A printer controller 201 is a controller for expanding image data sent from an external device such as a host computer into bitmap data. An engine controller 202 is a controller that controls each unit of the image forming apparatus 100 in accordance with an instruction of the printer controller 201. A high-voltage control unit 203 controls charging voltages, developing voltages, and transfer voltages in accordance with an instruction of the engine controller 202. An exposure control unit 204 controls driving/stopping of the scanner motor 104 and illumination/extinguishing of the semiconductor laser 103 in accordance with an instruction of the engine controller 202. A fixing control unit 205 controls supplying/shutting off of an alternating-current voltage to the fixing device 111 in accordance with an instruction of the engine controller 202. A conveyance control unit 207 controls driving/stopping of a motor that drives conveyance rollers, a pressurizing roller of the photoreceptor 102 and the fixing device 111, and the like in accordance with an instruction of the engine controller 202. A power supply unit 208 generates electric power and supplies it to the engine controller 202, the printer controller 201, and the like. For example, the power supply unit 208 generates direct current voltages of 24 V, 12 V, 5 V, 3.3 V, and the like. The direct current voltage of 24 V among these direct current voltages is supplied to the high-voltage control unit 203, the exposure control unit 204, the fixing control unit 205 and the conveyance control unit 207 via the interlock circuit 130. When a user opens the door 120, the interlock circuit 130 shuts off the supply of the current voltage of 24 V. When the voltage of 24 V is shut off, the fixing control unit 205 shuts off an alternating current to the fixing device 111. Another interlock circuit 130 may be inserted on a power supply line (a power supply pattern on a circuit board) used for supplying an alternating current to the fixing device 111.

Figure 3:
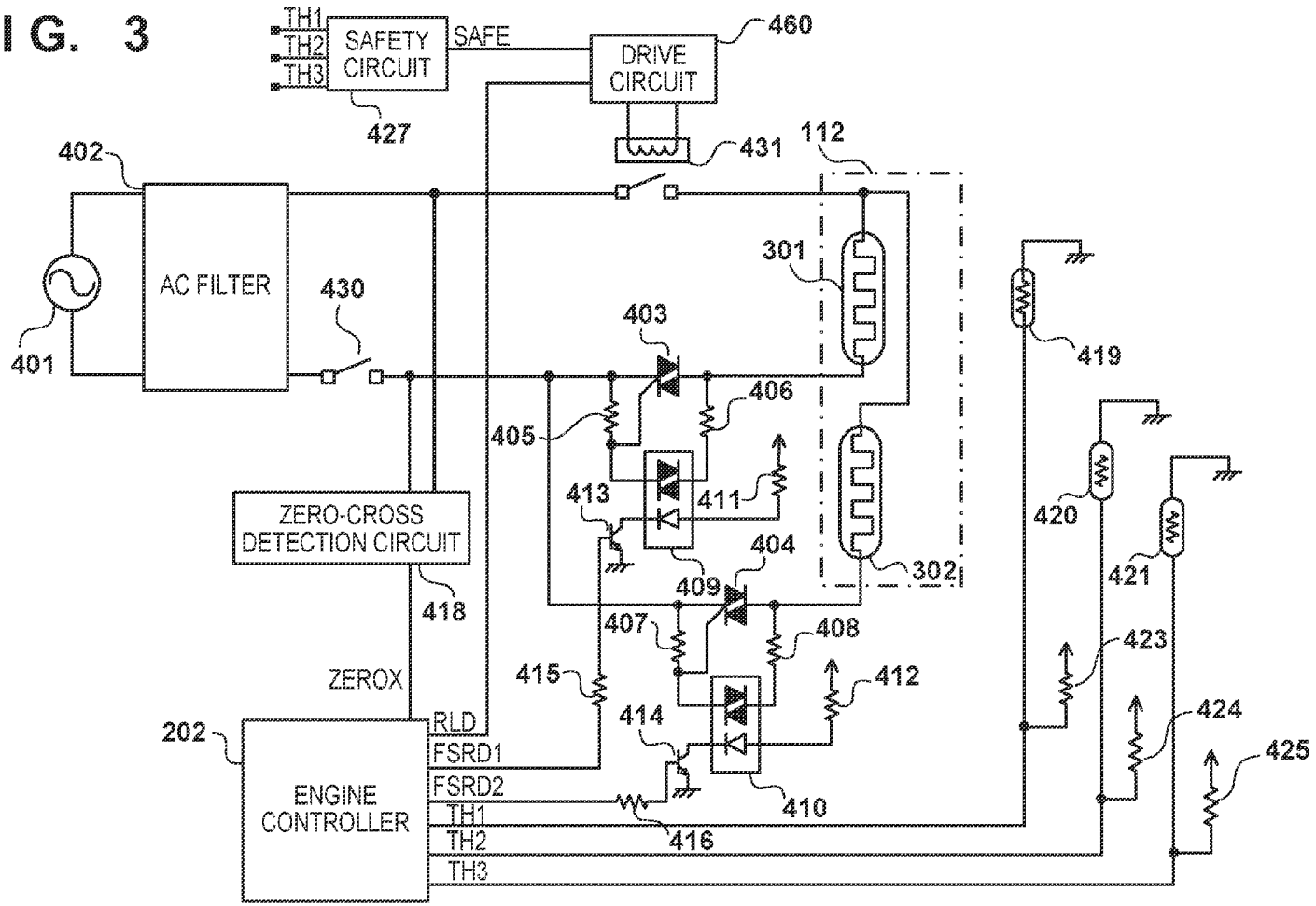
FIG. 3 is a circuit diagram of a fixing control unit.

FIG. 3 is a circuit diagram showing an example of the drive circuit of the fixing control unit 205. An alternating-current power supply 401 is an external power supply such as a commercial power supply. An alternating current supplied from the alternating-current power supply 401 is subjected to a noise cutting process using an AC filter 402, and supplied to heating bodies 301, 302 provided on a fixing heater 112 of the fixing device 111. A gate-controlled semiconductor switch 403 supplies and shuts off electric power to the heating body 301. A gate-controlled semiconductor switch 404 supplies and shuts off electric power to the heating body 302. Bias resistors 405, 406 are resistor elements used for driving the gate-controlled semiconductor switch 403. Bias resistors 407, 408 are resistor elements used for driving the gate-controlled semiconductor switch 404. Photogate-controlled semiconductor switch couplers 409, 410 are elements used for insulating a primary side and a secondary side from each other. The gate-controlled semiconductor switches 403, 404 are individually turned on by supplying electrical power individually to light emitting diodes provided on the photogate-controlled semiconductor switch couplers 409, 410. Limiting resistors 411, 412 are resistor elements that limit current flowing to the photogate-controlled semiconductor switch couplers 409, 410. Transistors 413, 414 are control elements that respectively control switching on/off of the photogate-controlled semiconductor switch couplers 409, 410. The transistor 413 operates in accordance with a heater drive signal FSRD1 supplied from the engine controller 202 via a resistor 415. The transistor 414 operates in accordance with a heater drive signal FSRD2 supplied from the engine controller 202 via a resistor 416. The engine controller 202 turns on the gate-controlled semiconductor switch 403 by changing the signal level of the heater drive signal FSRD1 to "high", and turns off the gate-controlled semiconductor switch 403 by changing the signal level of the heater drive signal FSRD1 to "low". The engine controller 202 turns on the gate-controlled semiconductor switch 404 by changing the signal level of the heater drive signal FSRD2 to "high", and turns off the gate-controlled semiconductor switch 404 by changing the signal level of the heater drive signal FSRD2 to "low". A voltage of a level corresponding to the "high" level is a voltage output from the port of the engine controller 202, which is a voltage equivalent to an operating voltage supplied to the engine controller 202. A voltage of a level corresponding to the "low" level is a voltage equivalent to the potential of the grounding point (ground potential) of the engine controller 202. A zero-cross detection circuit 418 detects a zero cross of an alternating current supplied from the alternating-current power supply 401. For example, using a pulse signal (hereinafter referred to as "zero cross signal"), the zero-cross detection circuit 418 notifies the engine controller 202 that an alternating-current voltage has become a voltage that is less than or equal to a threshold. The engine controller 202 determines timing of supplying electric power to the gate-controlled semiconductor switches 403, 404 using the edge of the pulse of the zero-cross signal as a reference, and controls switching on/off of the gate-controlled semiconductor switches 403, 404.

A thermistor 419 is a sensor for detecting the temperature of the center portion of the fixing heater 112. Thermistors 420, 421 are sensors for detecting the temperature of the end portions of the fixing heater 112. The outputs of the thermistors 419, 420, 421 are subjected to a voltage dividing process by respectively corresponding resistors 423, 424, 425, and input as respective TH1, TH2 and TH3 signals into the engine controller 202 and a safety circuit 427. Each of the thermistors 419, 420, 421 may be a NTC thermistor. NTC is an abbreviation for negative temperature coefficient. An NTC thermistor has a smaller resistance value as a temperature rises. That is, the voltages of TH1, TH2 and TH3 signals become smaller as well. The engine controller 202 monitors the temperature of the fixing heater 112, and adjusts the electric power supplied to the heating bodies 301, 302 to be at a target temperature.

A relay 431, which is an electromagnetic relay, is a type of switch whose primary side and secondary side are insulated from each other. The contact of the relay 431 is arranged on a power supply line used for supplying a current from the alternating-current power supply 401 to the heating bodies 301, 302. A drive circuit 460 is a circuit for driving the relay in accordance with an RLD signal output by the CPU 209 of the engine controller 202. The safety circuit 427 is a circuit for detecting a temperature error (e.g., overheating) of the fixing device 111 and mandatorily stopping the supply of power to the fixing heater 112. The safety circuit 427 compares, for example, the TH1, TH2 and TH3 signals obtained by the thermistors 419, 420, 421 to a reference temperature used for determining an abnormality of the fixing device 111. If the safety circuit 427 determines that the fixing heater 112 is normal based on the result of the comparison, a SAFE signal is maintained at a low level. In the case where the SAFE signal is at the low level, the RLD signal output by the engine controller 202 is activated, whereby the engine controller 202 can control the relay. In the case where the safety circuit 427 determines that the fixing heater 112 is not normal, the SAFE signal is changed to be at a high level. In the case where the SAFE signal is at the high level, the safety circuit 427 mandatorily turns off the relay 431 regardless of a control signal of the engine controller 202, and shuts off the supply of power to the fixing heater 112. Accordingly, the fixing heater 112 is protected against overheating.

A thermoswitch 430 is a circuit component that is provided so as to be in contact with the fixing heater 112 and shuts off electric power due to the contact of the switch being released when a predetermined temperature is exceeded. The thermoswitch 430 also functions as a protection mechanism for shutting off the supply of power when the temperature of the fixing device 111 is too high. The thermoswitch 430 and the relay 431 operate independently, thereby improving the reliability of the fixing device 111.

Figure 4:
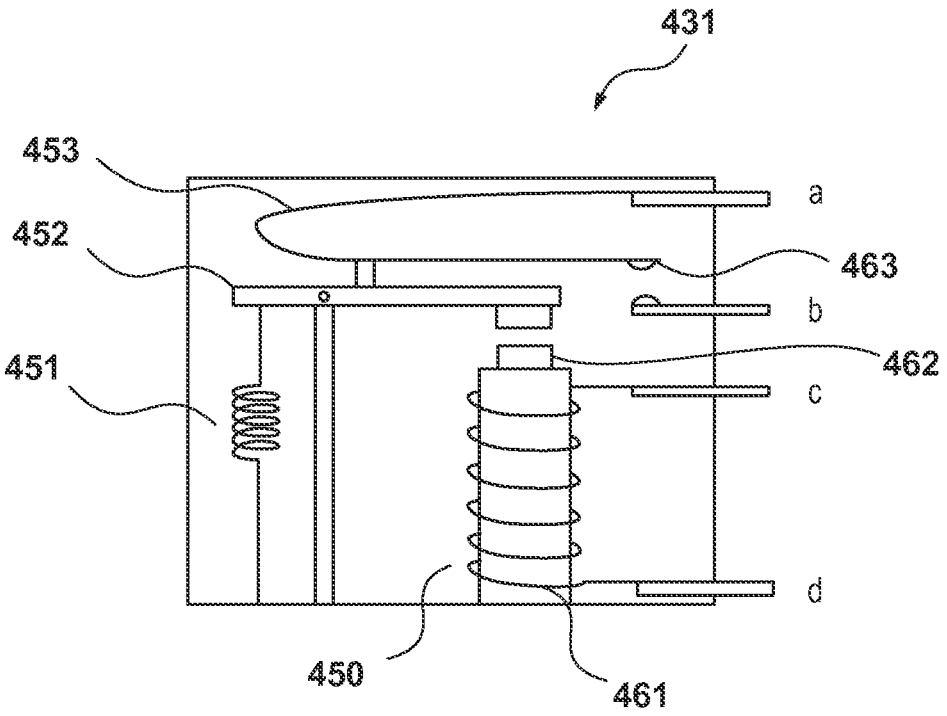
FIG. 4 is a diagram showing an internal structure of a typical relay.

A relay on voltage and a relay off voltage will be described with reference to FIG. 4. An electromagnet 450 has a coil 461 and an iron core 462. A movable plate 452 is provided in an axial direction of the iron core 462 of the electromagnet 450. The movable plate 452 is a type of seesaw. A spring 451 is exerting a force at one end of the movable plate 452 so that the electromagnet 450 and the movable plate 452 separate from each other. A contact point terminal 453 is connected to the movable plate 452, and moves along with the movable plate 452. Terminals a, b are primary side terminals, and terminals c, d are secondary side terminals. One end of the contact point terminal 453 is connected to the terminal a, and the other end 463 is arranged to face the terminal b. The terminal c is connected to one end of the coil 461, and the terminal d is connected to the other end of the coil 461. When electric power is supplied to the terminals c, d, the contact point of the movable plate 452 is attracted to the electromagnet 450. Due to the movement of the movable plate 452, the contact point terminal 453 is brought into contact with the terminal b, and the terminal a and the terminal b are then electrically connected. When the supply of power to the terminals c, d is shut off, the magnetic force of the electromagnet 450 weakens, and the action of the spring 451 makes the movable plate 452 and the electromagnet 450 separate from each other. In conjunction with the movable plate 452, the other end 463 of the contact point terminal 453 separates from the terminal b, thereby bringing the terminal a and the terminal b into a state of being insulated from each other.

Figures 5A, 5B, 5C:
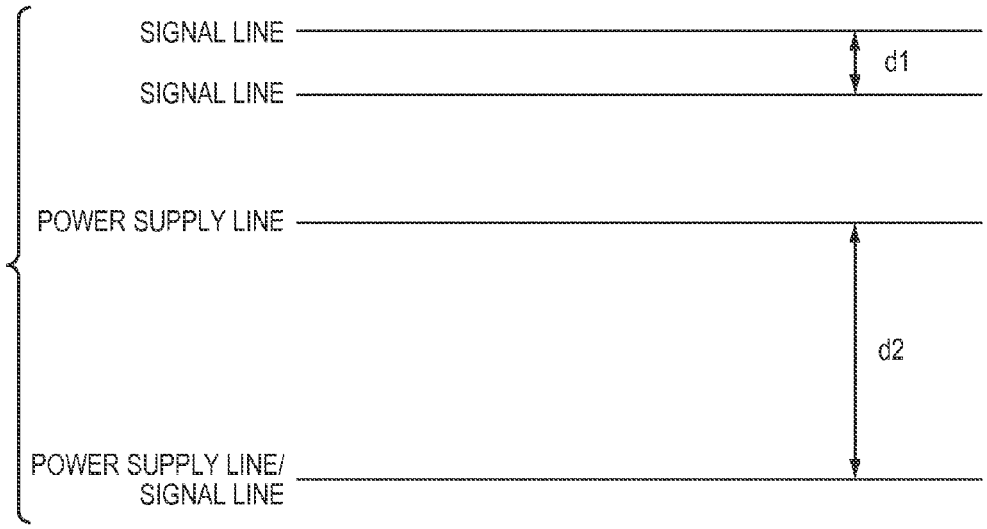
FIG. 5A is a diagram for describing a relay on voltage and a relay off voltage.
FIGS. 5B and 5C are diagrams for describing inter-pattern distances.

FIG. 5A is a diagram indicating a relay on voltage and a relay off voltage of a typical relay using percentages of voltages applied to a coil with respect to rated voltages. The relay on voltage is a voltage necessary for turning on a relay. The relay off voltage is a voltage necessary for turning off a relay. As shown in FIG. 5A, because a relay has magnetic hysteresis, the relay on voltage and the relay off voltage are different from each other. For example, a 24V-rated relay is turned on when a voltage applied to a coil becomes 16.8 V or more, and turned off when the voltage becomes less than 2.4 V. In the case of attempting to turn off a turned-on relay, the on state is maintained until the voltage applied to the coil of the relay reaches 2.4 V.

FIG. 5B and FIG. 5C show a typical inter-pattern distance (distance between lines) d1 and an enlarged inter-pattern distance d2. Wiring patterns such as various signal lines and power supply lines are arranged on a circuit board. A distance of some extent is required between lines adjacent to each other in order to prevent interference from/on each line. The typical inter-pattern distance d1 is, for example, a distance between a signal line of the CPU 209 and another signal line adjacent thereto. Accordingly, the typical inter-pattern distance d1 can be referred to as a distance between signal lines. On the other hand, the enlarged inter-pattern distance d2 is, for example, a distance between a power supply line at the rear stage of the interlock circuit 130 and another power supply line. Accordingly, the enlarged inter-pattern distance d2 can be referred to as a distance between power supply lines. Conventionally, this enlarged inter-pattern distance d2 has been adopted as an inter-pattern distance between the power supply line at the rear stage of the interlock circuit 130 and a signal line as well. One of the two inter-pattern distances has been adopted depending on whether an adjacent line is a signal line or a power supply line in this manner. If the typical inter-pattern distance d1 can be adopted as a distance between a power supply line and a signal line as well, it will be possible to further reduce the size of a circuit board.

Figure 6:
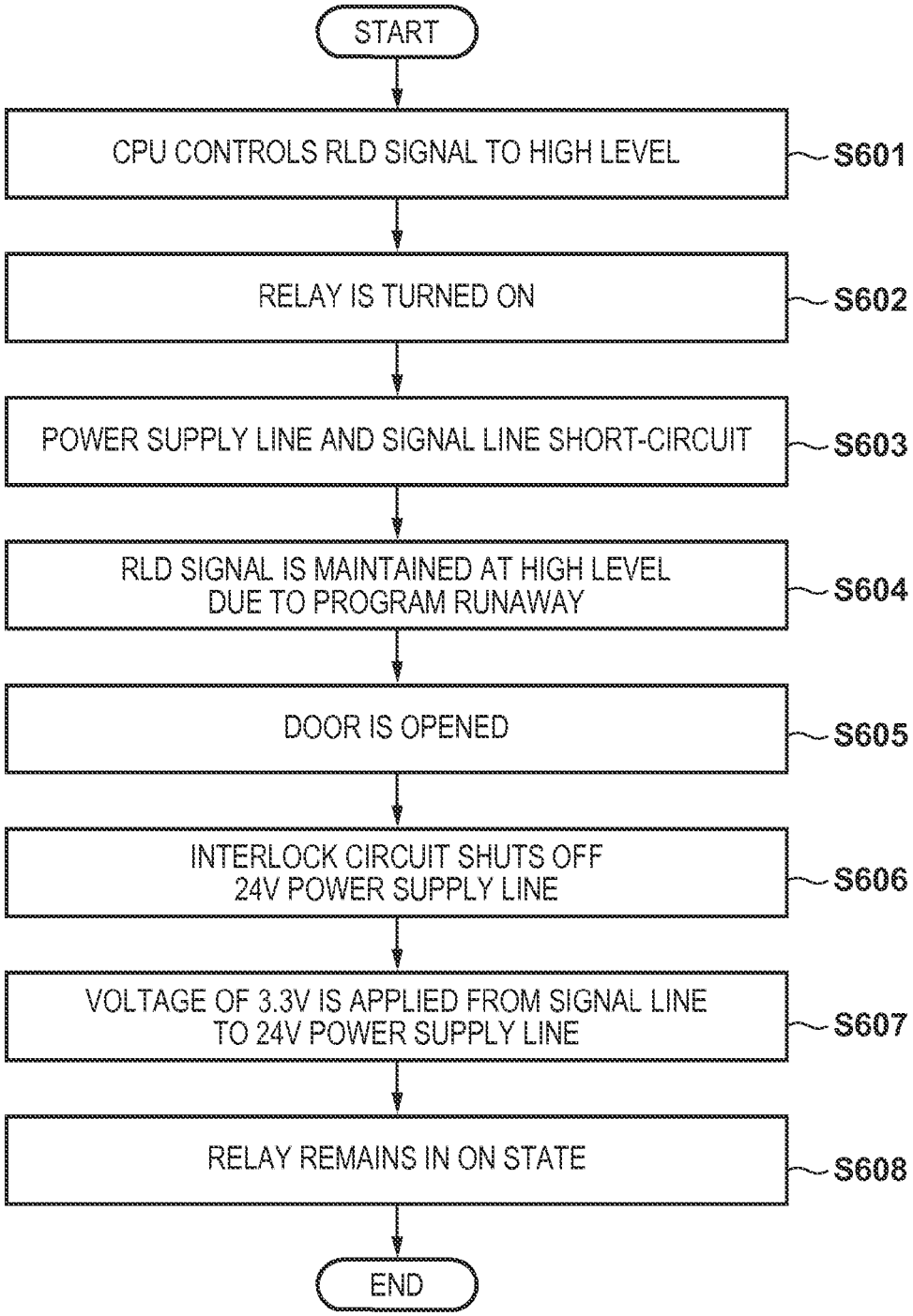
FIG. 6 is a diagram for describing an error mode.

FIG. 6 shows an example of the operations of the image forming apparatus 100, which is envisioned in the case where an inter-pattern distance between a power supply line at the rear stage of the interlock circuit 130 and a signal line is the typical inter-pattern distance d1. In step S601, the CPU 209 of the engine controller 202 controls the level of the RLD signal to be a "high" level, and changes the mode of the image forming apparatus 100 to a stand-by mode. In step S602, when the RLD signal reaches the "high" level, a drive voltage is applied to the coil 461 of the relay 431 and the contact point on a primary side is electrically connected, thereby bringing the relay 431 into an on state. In step S603, a 24V power supply line at the rear stage of the interlock circuit 130 and an adjacent signal line extending from the CPU 209 abruptly short-circuit due to foreign material or the like. In step S604, program runaway in the CPU 209 abruptly occurs, and the CPU 209 maintains the RLD signal at the "high" level. In step S605, a user opens the door 120. In step S606, the interlock circuit 130 detects that the door 120 has been opened and shuts off the 24V power supply line. However, the short-circuiting has occurred in S603. Accordingly, in 607, a voltage of 3.3 V, the output voltage of the CPU 209, is supplied to the 24V power supply line through the short-circuited location. The voltage of 3.3 V applied to the terminals c, d, which are drive terminals of the relay 431, is greater than 2.4 V, a relay off voltage. Accordingly, in S608, the relay 431 remains in an on state.

In this manner, in the case where the inter-pattern distance between the power supply line and the signal line is the typical inter-pattern distance d1, the relay 431 remains in an on state due to the power supply line and the signal line short-circuiting. That is, an alternating-current voltage is still applied to the fixing device 111. Therefore, in order to adopt the typical inter-pattern distance d1 as the inter-pattern distance between the power supply line and the signal line, a safety mechanism for reliably turning off the relay 431 even if short-circuiting occurs is necessary.

Figures 7A, 7B, 7C:
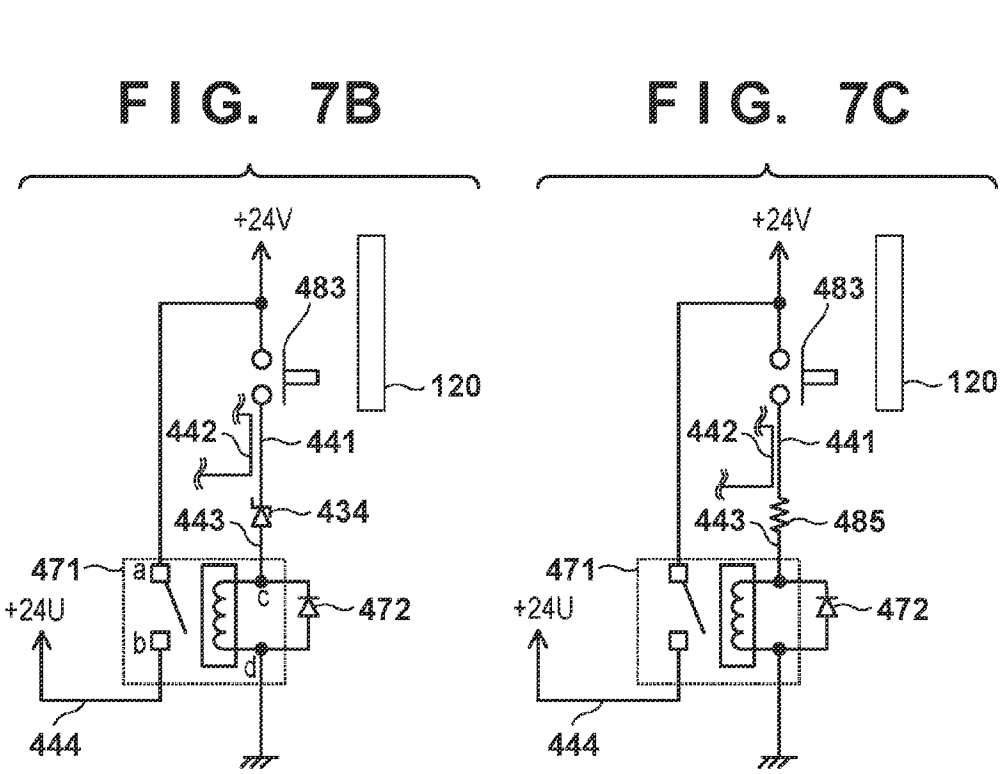
FIG. 7A is a circuit diagram of a drive circuit.
FIGS. 7B and 7C are circuit diagrams of interlock circuits.

FIG. 7A is a circuit diagram of the drive circuit 460, which is a characterizing portion of the present invention. A transistor 433 is a switching element used for driving the relay 431. A limiting resistor 432 is a resistor for limiting a current applied to the base terminal of the transistor 433. A limiting resistor 429 is a resistor for limiting a current applied to the base terminal of a transistor 428. Note that the transistor 428 is a transistor for mandatorily setting the potential of the base terminal of the transistor 433 to low. A diode 435 is a regenerative diode for causing a current caused by a counter-electromotive force generated in the coil of the relay 431 to flow. The interlock circuit 130 is turned on by a closing operation of the door 120, and turned off by an opening operation of the door 120. Rectification diodes 481, 482 are diodes that function as voltage drop elements.

It is assumed that the length of a pattern 127 connecting the rectification diode 481 and the rectification diode 482 is short and there is no signal line adjacent to the pattern 127. Moreover, it is assumed that the length of a pattern 128 connecting the rectification diode 482 and the relay 431 is also short, and there is no signal line adjacent to the pattern 128. The inter-pattern distance between a power supply line 125 connecting the interlock circuit 130 and the rectification diode 481 and a signal line 126 extending from the CPU 209 is assumed to be the typical inter-pattern distance d1.

The rectification diodes 481, 482 are typical diodes, and both have forward direction voltages of 0.7 V. Because the relay 431 has a rating of 24 V, a relay on voltage is 16.8 V, a relay off voltage is 2.4 V, and its maximum rated voltage applied to the coil 461 is 31.2 V. A collector-emitter voltage Vice of the transistor 433 is 0.3 V. Each of these numerical values is merely an example.

The RLD signal output from the CPU 209 of the engine controller 202 is applied to the base terminal of the transistor 433 via the limiting resistor 432. When the RLD signal reaches a high level, the transistor 433 allows a current to flow through the coil 461 of the relay 431. Accordingly, the coil 461 is excited, and the contact point on the primary side is electrically connected. The SAFE signal output from the safety circuit 427 is applied to the base terminal of the transistor 428. When the SAFE signal reaches a high level, the transistor 428 mandatorily controls the potential of the base terminal of the transistor 433 to be low.

Figure 8A:
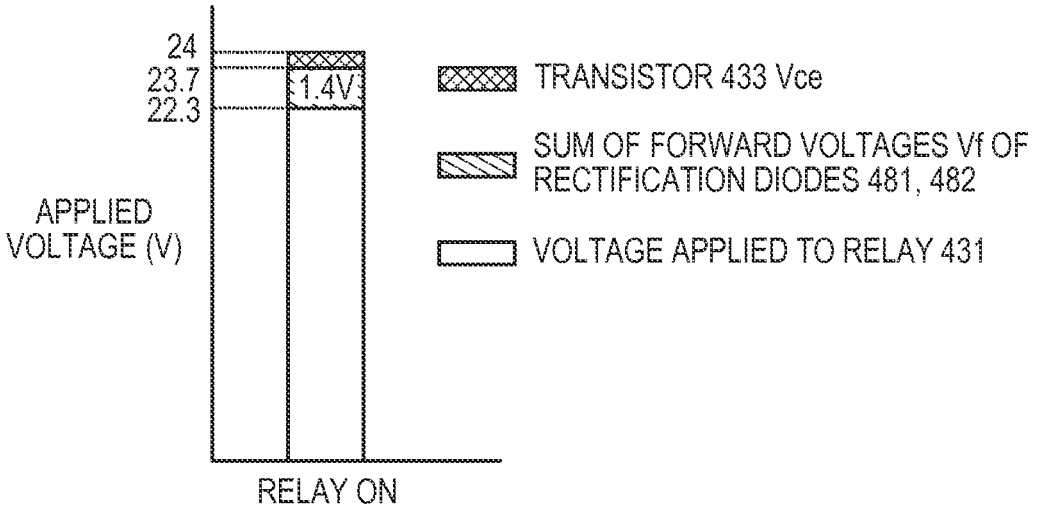
FIGS. 8A and 8B are diagrams for describing voltages applied to respective elements.

FIG. 8A shows voltages applied to respective elements in order to turn on the relay 431. When the door 120 is closed, the interlock circuit 130 supplies a voltage of 24 V to the drive circuit 460. When the transistor 433 is turned on due to the RLD signal output by the CPU 209, a voltage of 0.3 V is applied to the collector-emitter voltage Vice of the transistor 433. A forward voltage Vf of 0.7 V is applied to the rectification diode 481. A forward voltage Vf of 0.7 V is applied to the rectification diode 482 as well. That is, the total voltage drop in the transistor 433, the rectification diode 481, and the rectification diode 482 is 1.7 V. Therefore, a voltage applied to the relay 431 is 22.3 V, which is higher than 16.8 V, the relay on voltage. Therefore, the relay 431 is turned on.

Figure 8B:
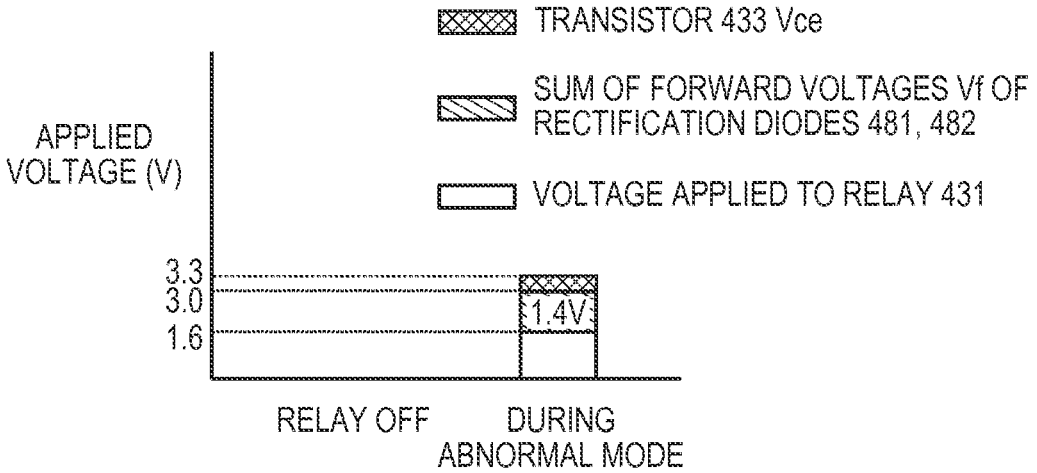

FIG. 8B shows voltages applied to respective elements in order to turn off the relay 431, and voltages applied to respective elements when short-circuiting occurs as shown in FIG. 6. In order to turn off the relay 431, the CPU 209 switches the level of the RLD signal to a low level. As a result, the transistor 433 is turned off, and a voltage applied to the relay 431 becomes 0 V. On the other hand, when short-circuiting as shown in FIG. 6 occurs, a voltage of 3.3 V is applied from a signal line 126 to the 24 V power supply line 125. Meanwhile, a voltage of 0.3 V as the voltage Vce is applied between the collector and emitter of the transistor 433, and a voltage of 0.7 V, which is the forward voltage Vf, is applied to each of the rectification diodes 481, 482. Therefore, the voltage applied to the relay 431 becomes 1.6 V (=3.3 V−1.7 V). Because this voltage is lower than 2.4 V, the relay off voltage of the relay 431, it is possible to turn off the relay 431.

Figure 9:
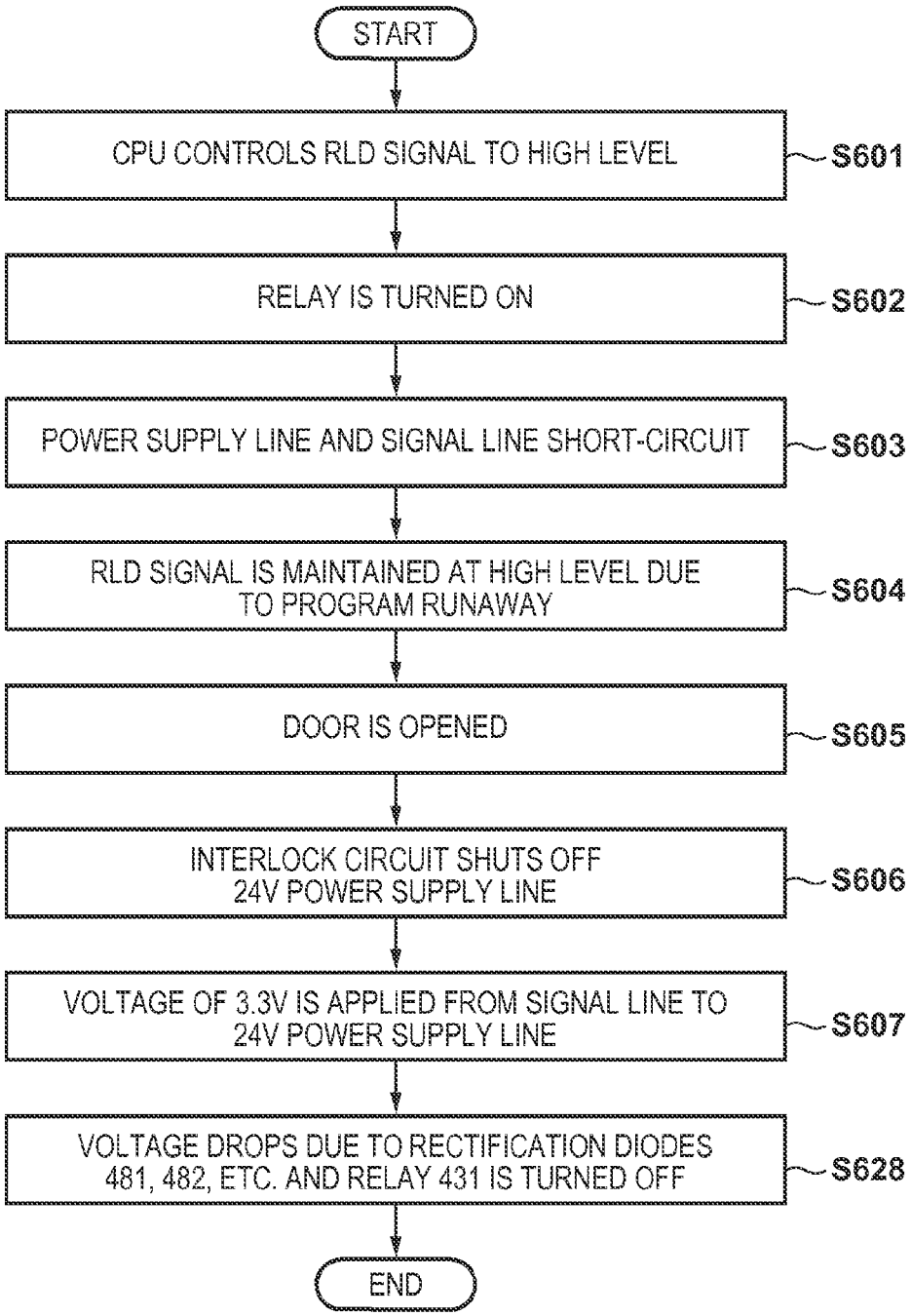
FIG. 9 is a diagram for describing an error mode.

FIG. 9 is a diagram for describing the operations of a drive circuit when short-circuiting occurs. Because steps S601 to S607 are the same as in FIG. 6, they are denoted by the same reference signs and description thereof is omitted here. Due to short-circuiting, a voltage of 3.3 V is output from the signal line 126 to the 24V power supply line 125 at a rear stage of the interlock circuit 130. In step S628, the voltage of 3.3 V drops to 1.6 V due to the rectification diodes 481, 482 and the transistor 433, and the relay 431 is turned off.

Adding the rectification diodes 481, 482 as voltage drop elements in this manner makes it possible to ensure that the inter-pattern distance between the 24V power supply line 125 and the signal line 126 extending from a logical circuit such as the CPU 209 is the typical inter-pattern distance d1. However, the power supply line from the rectification diode 481 to the transistor 433 is assumed to be sufficiently spaced apart from another power supply line and signal line. That is, in this section, the enlarged inter-pattern distance d2 is adopted. The power supply line 125 at the rear stage of the interlock circuit 130 is connected, in addition to the fixing control unit 205, to the high-voltage control unit 203, the exposure control unit 204, and the conveyance control unit 207 as well. By adopting the typical inter-pattern distance d1 as this inter-pattern distance between the power supply line 125 and the signal line 126, it becomes possible to reduce the size of the substrate.

By arranging voltage drop elements in the same substrate as the relay 431 and the transistor 433 for driving the relay 431, it becomes possible to shorten the part of the wiring pattern in which the distance d2 needs to be obtained. Moreover, shortening the length of the wiring pattern from the voltage drop elements to the relay 431 and the transistor 433 for driving the relay 431 makes it possible to shorten the part of the wiring pattern in which the distance d2 needs to be obtained.

In the present embodiment, the voltage drop elements are arranged at a front stage of the relay 431, but they can also be arranged at a rear stage of the relay 431 or at a rear stage of the transistor 433.

As described above, by arranging the rectification diodes 481, 482 in series with the relay 431, it is possible to realize an interlocking function even if short-circuiting occurs between the power supply line 125 and the signal line 126. Moreover, because the distance between the power supply line 125 and the signal line 126 can be the typical inter-pattern distance d1, it is possible to reduce the sizes of the circuit and the substrate.

Second Embodiment

In the first embodiment, description was given with a focus on the relay 431 used for supplying electric power to the fixing device 111. In a second embodiment, a relay used for the interlock circuit 130 will be described. Because FIG. 1, FIG. 2, FIG. 4, FIG. 5A and FIG. 5B are the same as those in the first embodiment, description thereof is omitted.

FIG. 7B is a circuit diagram of the interlock circuit 130 according to the second embodiment. A relay 471 has a structure similar to that of the relay 431 shown in FIG. 4. A regenerative diode 472 is connected to a terminal c and a terminal d. The terminal d is grounded. A switch 483 is turned on/off in conjunction with the opening/closing of the door 120, and supplies and shuts off electric power to the relay 471. A Zener diode 434 is a voltage drop element. The switch 483 is provided on the body of the image forming apparatus 100, and detects opening/closing of the door 120. The relay 471 is arranged, for example, in the substrate of the power supply unit 208. Moreover, an inter-pattern distance between a power supply line 441 and a signal line 442 from the switch 483 to the Zener diode 434 is assumed to be the typical inter-pattern distance d1. The length of a power supply line 443 from the Zener diode 434 to the relay 471 is short, and there is no adjacent signal line. The Zener voltage of the Zener diode 434 is 12 V. The relay 471 has a rating of 12 V, a relay on voltage of 8.4 V, and a relay off voltage of 1.2 V, and its maximum rated voltage applied to a coil is 15.6 V. A +24V voltage is supplied to a power supply line 444 at the rear stage of the interlock circuit 130, and used as a power supply +24 U.

When the door 120 is closed, the switch 483 is turned on, electric power is supplied to the relay 471, and the coil 461 of the relay 471 is excited. Accordingly, a switch in the relay 471 is turned on and the voltage of +24 V is output as the power supply +24 U. On the other hand, when the door 120 is opened, the switch 483 is turned off, the supply of power to the relay 471 is shut off, and the switch in the relay 471 is turned off. Accordingly, the supply of the +24V voltage to the power supply line 444 is shut off.

In order to describe advantages of adopting the Zener diode 434 as a voltage drop element, first, operations in the case where the Zener diode 434 does not exist will be described. The power supply lines 441, 443 and the signal line 442 which form a wiring pattern from the switch 483 to the relay 471 may short-circuit due to foreign material or the like. When short-circuiting occurs, a voltage of 3.3 V generated by the CPU 209 is supplied to the power supply lines 441, 443 through the signal line 442 even if the door 120 is opened and the switch 483 is switched off. The voltage of 3.3 V is greater than 1.2 V, the relay off voltage of the relay 471. Accordingly, even if the door 120 is opened in a state where the relay 471 is on, the relay 471 remains in an on state. In order to turn off the relay 471 with an opening operation of the door 120 when such short-circuiting occurs, the Zener diode 434 is arranged in the vicinity of the relay 471.

Figure 10A:
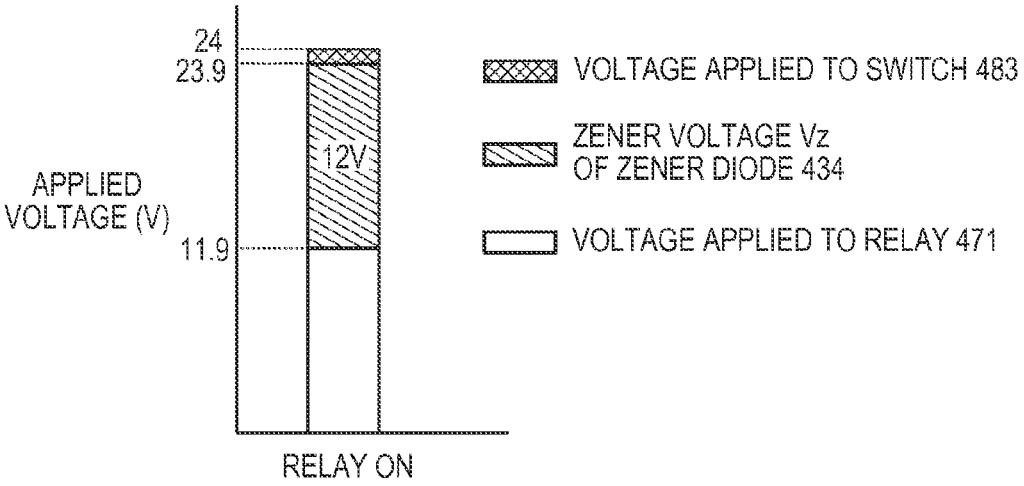
FIGS. 10A and 10B are diagrams for describing voltages applied to respective elements.

FIG. 10A shows voltages applied to respective elements when the relay 471 is turned on. When the door 120 is closed, the switch 483 is turned on. Voltage drop caused by a resistance component of the switch 483 is assumed to be 0.1 V. Because the Zener voltage Vz of the Zener diode 434 is 12 V, a voltage drop of 12 V occurs. Therefore, the voltage applied to the relay 471 is 11.9 V (=24 V−(0.1 V+12 V)), which is higher than 8.4 V, the relay on voltage. Therefore, the relay 471 can be turned on. In this manner, even if the Zener diode 434 is added, the relay 471 can be turned on by closing the door 120.

Figure 10B:
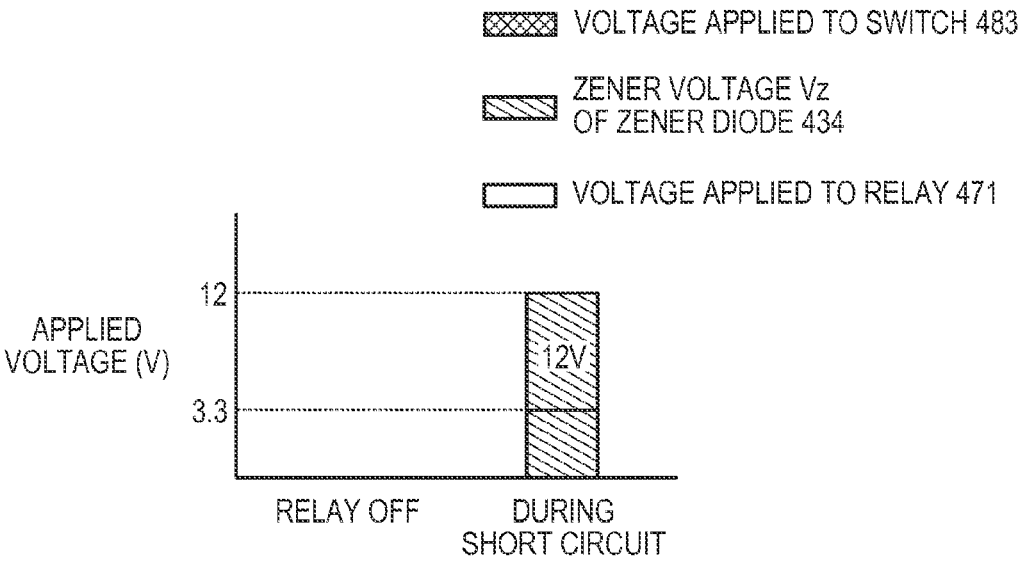

FIG. 10B shows voltages applied to respective elements when the relay 471 is turned off by opening the door 120 and voltages applied to respective elements when short-circuiting occurs. When the door 120 is opened, the switch 483 is turned off, and the voltage applied to the relay 471 reaches 0 V. On the other hand, when short-circuiting occurs, the potential of the power supply line 441 reaches 3.3 V. The voltage of 3.3 V caused by the short-circuiting is lower than the Zener voltage Vz of the Zener diode 434. Therefore, a Zener current does not flow in the Zener diode 434. Therefore, a voltage applied to the relay 471 is 0 V, and thereby the relay 471 can be turned off.

As described above, arranging the Zener diode 434 in series with the relay 471 makes it possible to reliably shut off the supply of the +24V voltage when the door 120 is opened. This can be achieved even if the power supply line 441 from the switch 483 for detecting the door 120 being opened to the Zener diode 434 and the signal line 442 from the CPU 209 or a logical circuit such as ASIC short-circuit. Therefore, the inter-pattern distance between the power supply line 441 and the signal line 442 can be configured with the typical inter-pattern distance d1, and it is possible to achieve reduction in the sizes of the circuit and the substrate.

Third Embodiment

In the second embodiment, the Zener diode 434 was used as a voltage drop element. In a third embodiment, a resistor element is used as a voltage drop element. Since FIG. 1, FIG. 2, FIG. 4, and FIG. 5B are the same as those in the first embodiment and the second embodiment, description thereof is omitted here.

FIG. 7C is a circuit diagram of the interlock circuit 130 according to the third embodiment. In comparison with FIG. 7B, the Zener diode 434 is replaced by a resistor 485 in FIG. 7C. A resistance value R1 of the resistor 485 is 360Ω. It is assumed that a resistance value R2 of the coil 461 of the relay 471 is 360Ω. Other configurations are the same as those of the second embodiment, and description thereof is omitted. However, description will be given with the assumption that the relay off voltage V1 of the relay 471 is 2.4 V.

Figure 11A:
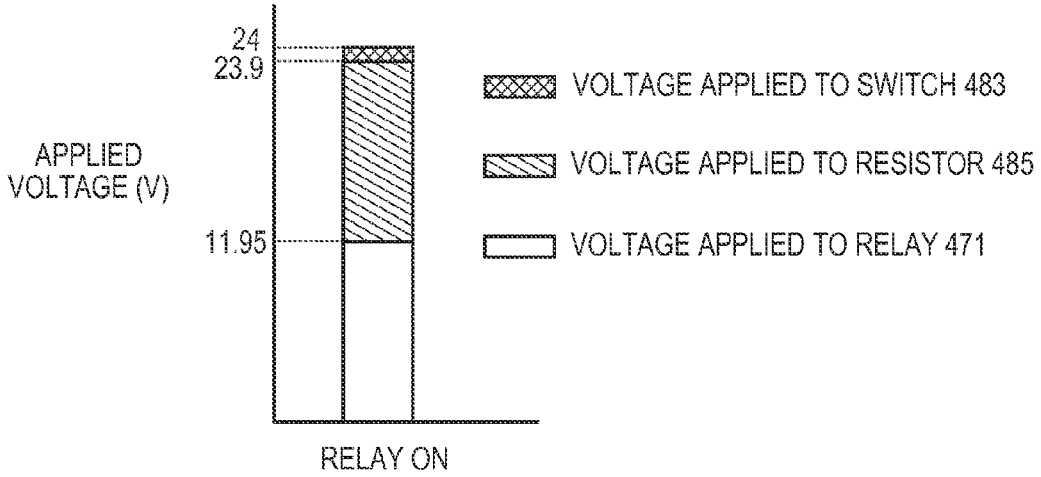
FIGS. 11A and 11B are diagrams for describing voltages applied to respective elements.

FIG. 11A shows voltages applied to respective elements when the relay 471 is turned on. When the door 120 is closed, the switch 483 is turned on. A voltage drop caused by a resistance component of the switch 483 is 0.1 V. A voltage of 11.95 V obtained by a voltage dividing process performed with the resistance of the resistor 485 and the coil 461 is applied to the resistor 485. Therefore, a voltage applied to the relay 471 is 11.95 V, which is higher than 8.4 V, the relay on voltage V2, and thereby the relay 471 can be turned on.

Figure 11B:
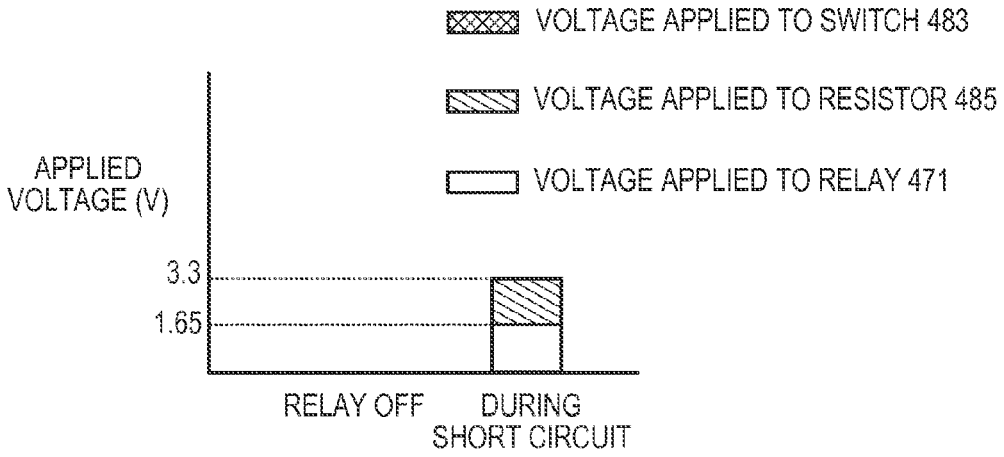

FIG. 11B shows voltages applied to respective elements when the door 120 is opened and the relay 471 is turned off, and voltages applied to respective elements when short-circuiting has occurred. When the door 120 is opened, the switch 483 is turned off and a voltage applied to the relay 471 reaches 0 V. On the other hand, when short-circuiting occurs, a voltage of 3.3 V is output from the signal line 442 to the power supply line 441. A voltage of 1.65 V obtained by dividing the voltage of 3.3 V using the resistor 485 and the relay 471 is applied to the resistor 485. That is, a voltage of 1.65 V (=3.3 V−1.65 V) is applied to the relay 471. The voltage of 1.65 V applied to the relay 471 is lower than 2.4 V, the relay off voltage V1 of the relay 471. Accordingly, it is possible to turn off the relay 471.

As described above, arranging the resistor 485, which is a voltage drop element, in series with the relay 471 makes it possible to reliably shut off the supply of a +24V voltage when the door 120 is opened. This can be realized even if short-circuiting occurs between the power supply line 441 and the signal line 442 of the CPU 209, ASIC or the like. The inter-pattern distance between the power supply line 441 and the signal line 442 can be configured with the typical inter-pattern distance d1, and it is possible to reduce the sizes of the circuit and the substrate.

SUMMARY

The door 120 has been described as an example of an opening and closing portion that can be opened and closed by a user. Note that the opening and closing portion can be another openable/closable structure component such as the sheet supplying cassette 113. With reference to FIG. 7A, the relay 431 was described as a switch that is turned off when a voltage applied to a drive terminal is less than a first voltage and turned on when a voltage applied to the drive terminal is greater than or equal to a second voltage that exceeds the first voltage. The drive terminal is, for example, the terminals c, d. Moreover, the relay 471 was described with reference to FIG. 7B and FIG. 7C. Note that a semiconductor switch can be adopted instead of a relay. This is because a semiconductor switch is also turned on when a voltage applied to the drive terminal is greater than or equal to a threshold voltage, and is turned off when it is less than the threshold voltage. As described with reference to FIG. 2, the power supply unit 208 was described as an example of a drive unit for generating a drive voltage. With reference to FIG. 7A, the power supply line 125 was described as an example of a first line used for applying a drive voltage to the drive terminal of a switch. Moreover, with reference to FIG. 7B and FIG. 7C, the power supply line 441 was described as an example of the first line. Moreover, the signal lines 126, 442 were described as second lines arranged such that at least parts thereof are near the first line. The rectification diodes 481, 482, the transistor 433, the Zener diode 434, the resistor 485, and the like were described as examples of voltage drop elements provided on the first line and drop a voltage applied to the drive terminal. Note that these can be used in combination as appropriate. When the first line and the second line short-circuit in a state where the door 120 is opened, the voltage drop element drops a voltage supplied from the second line through the first line to the drive terminal by a predetermined voltage so as to lower the voltage applied to the drive terminal to below the first voltage so that the switch is turned off. As described with reference to FIG. 8B, the voltage of 3.3 V supplied from the signal line 126 using the power supply line 125 drops to 1.6 V due to the rectification diodes 481, 482 and the transistor 433. Because this is below 2.4 V, which is the first voltage of the relay 431, an alternating current to the fixing device 111, which is a load, can be shut off when the door 120 is opened, even if short-circuiting has occurred. As described with reference to FIG. 10B, the voltage of 3.3 V applied from the signal line 442 through the power supply line 441 drops to 0 V due to the Zener diode 434. Because this is below 1.2 V, the first voltage of the relay 431, a direct current to the motor of the conveyance control unit 207, which is a load, can be shut off when the door 120 is opened even if short-circuiting has occurred. As described with reference to FIG. 11B, the voltage of 3.3 V applied from the signal line 442 through the power supply line 441 is divided using the resistance of the resistor 485 and the coil 461, and drops to 1.65 V. Because this is below 2.4 V, the first voltage of the relay 431, a direct current to the motor of the conveyance control unit 207, which is a load, can be shut off when the door 120 is opened, even if short-circuiting has occurred.

Note that a difference ΔV between a drive voltage V0 generated by the power supply unit 208 when the door 120 is closed and a predetermined voltage Vd is greater than or equal to the second voltage V2. In FIG. 8A, V0 is 24 V, the predetermined voltage Vd is 1.7, the difference ΔV is 22.3 V, and V2 is 16.8 V. Therefore, even if the rectification diodes 481, 482 are adopted as voltage drop elements, the relay 431 can start the supply of power to a load in conjunction with the closing of the door 120.

As described with reference to FIG. 7A, the rectification diodes 481, 482 are inserted on the first line as a plurality of diodes. In this case, the predetermined voltage is the total value of the forward direction voltages of the plurality of diodes. Note that the total value of the breakdown voltages of the plurality of diodes may also be adopted.

It is sufficient that the voltage drop element is arranged at any position on the first line from the power supply unit 208 or the interlock circuit 130 to a grounding point. In FIG. 7A, the rectification diodes 481, 482 are arranged between the interlock circuit 130 and the relay 431, and the transistor 433 is arranged on the power supply line from the relay 431 to the grounding point. Note that as an element provided between the relay 431 and the grounding point, any of a transistor, a diode or a resistor element may be used. In this manner, at a front stage or a rear stage of the relay 431, voltage drop elements can be arranged in a dispersed manner. In FIG. 7B, the Zener diode 434 is arranged at a front stage of the relay 471. Furthermore, in FIG. 7C, the resistor 485 is arranged at a front stage of the relay 471.

As described with reference to FIG. 7A to FIG. 7C, the signal lines 126, 442 may be a wiring pattern that transmits high level signals and low level signals output from a logical circuit or an integrated circuit. When the first line and the second line short-circuit in a state where the door 120 is open, a voltage applied from the second line through the first line to the drive terminal is a high level voltage among voltages of signals output from the logical circuit or the integrated circuit. Here, the voltage of 3.3 V was used as an example of the high level voltage, but voltages other than this may be adopted.

In the above-described example, a signal line was described as the second line, but the second line can be a power supply line that supplies an operating voltage to a logical circuit or an integrated circuit. Usually, a high level voltage output from a logical circuit is equal to an operating voltage of the logical circuit. Moreover, there are cases where a power supply line to the logical circuit can be arranged in such a manner as to be adjacent to a power supply line to a relay. Therefore, the present invention will be effective in such a case as well.

In the present embodiment, the image forming apparatus 100 was used as an example of an electrical device, but the present invention can be applied similarly to any electrical device that is provided with an interlock circuit as a safety circuit.

Note that a total value of voltage drop is denoted by Vd, the drive voltage supplied from the power supply unit 208 is denoted by V0, and the high level voltage is denoted by Vh. In this case, it is sufficient that Vd is designed so that $V0-Vd>-V2$ holds true and $Vh-Vd<V1$ holds true. That is, it is sufficient that the number and the type of voltage drop elements are selected so that such Vd can be obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-167954, filed Aug. 20, 2014, which is hereby incorporated by reference wherein in its entirety.

What is claimed is:

1. An image forming apparatus comprising:

an opening and closing portion configured to be capable of opening and closing;

a switch configured to be turned off when a voltage applied to a drive terminal is smaller than a first voltage and to be turned on when the voltage applied to the drive terminal is greater than or equal to a second voltage that exceeds the first voltage;

a drive unit configured to generate a drive voltage;

a first line configured to be used to apply the drive voltage to the drive terminal of the switch;

a second line arranged such that at least a part thereof is near the first line; and a voltage drop element provided on the first line and configured to drop the voltage applied to the drive terminal, wherein the voltage drop element drops a voltage applied from the second line through the first line to the drive terminal by a predetermined voltage when the first line and the second line short-circuit in a state where the opening and closing portion is open, so as to lower the voltage applied to the drive terminal to be smaller than the first voltage, thereby turning off the switch.

2. The image forming apparatus according to claim 1, wherein a difference between a drive voltage generated by the drive unit when the opening and closing portion is closed and the predetermined voltage is greater than or equal to the second voltage.

3. The image forming apparatus according to claim 1, wherein the opening and closing portion is a door that can be opened and closed by a user.

4. The image forming apparatus according to claim 1, wherein the switch is an electromagnetic relay.

5. The image forming apparatus according to claim 1, wherein the switch is a semiconductor switch.

6. The image forming apparatus according to claim 1, wherein the voltage drop element includes a diode.

7. The image forming apparatus according to claim 6, wherein the diode is a Zener diode.

8. The image forming apparatus according to claim 6, wherein a plurality of diodes are inserted on the first line, and the predetermined voltage includes a total value of forward voltages or breakdown voltages of the plurality of diodes.

9. The image forming apparatus according to claim 1, wherein the voltage drop element includes a resistor element.

10. The image forming apparatus according to claim 1, wherein the voltage drop element is provided on the first line between an interlock circuit that operates in accordance with opening/closing of the opening and closing portion and the switch.

11. The image forming apparatus according to claim 1, wherein the voltage drop element is provided on the first line between the switch and a grounding point.

12. The image forming apparatus according to claim 1, wherein the voltage drop element includes:

an element provided on the first line between an interlock circuit that operates in accordance with opening/closing of the opening and closing portion and the switch; and an element provided on the first line between the switch and a grounding point.

13. The image forming apparatus according to claim 12, wherein the element provided between the switch and the grounding point is a transistor, a diode or a resistor element.

14. The image forming apparatus according to claim 1, wherein the second line is a wiring pattern for transmitting high level signals and low level signals output from a logical circuit or an integrated circuit, and a voltage applied from the second line through the first line to the drive terminal when the first line and the second line short-circuit in a state where the opening and closing portion is open is a high level voltage among voltages of signals output from the logical circuit or the integrated circuit.

15. The image forming apparatus according to claim 1, wherein the second line is a power supply line used for supplying an operating voltage to a logical circuit or an integrated circuit.

16. The image forming apparatus according to claim 1, wherein the switch is a switch that is provided on a power supply line used for supplying an alternating current to a load and switches between supplying and shutting off the alternating current.

17. The image forming apparatus according to claim 16, wherein the load is a fixing device configured to fix a toner image transferred to a sheet onto the sheet.

18. The image forming apparatus according to claim 1, wherein the switch is a switch that is provided on a power supply line used for supplying a direct current to a load and switches between supplying and shutting off the direct current.

19. The image forming apparatus according to claim 18, wherein the load is a motor.

* * * * *